US005497988A

United States Patent [19]

Tolley et al.

[11] Patent Number: 5,497,988

[45] Date of Patent: Mar. 12, 1996

[54] GOLF DISTANCE MARKER

[76] Inventors: Philip A. Tolley, 4016 Tumbril Rd., Plano, Tex. 75023; Kraig A. Walker, 2104 Brabant Dr., Plano, Tex. 75025

[21] Appl. No.: 418,553

[22] Filed: Apr. 7, 1995

[51] Int. Cl.[6] ..... A63B 57/00

[52] U.S. Cl. ..... 273/32 H; 40/504; 273/176 L; 434/153

[58] Field of Search ..... 273/32 R, 32 H, 273/176 L; 40/493, 503, 504, 506; 434/153

[56] References Cited

U.S. PATENT DOCUMENTS

| | | | |
|---|---|---|---|
| 1,689,865 | 1/1927 | Davis et al. | 40/598 X |
| 1,832,947 | 11/1931 | Sears et al. | 273/176 L X |
| 2,154,966 | 4/1939 | Vanderveer | 40/140 |
| 2,155,992 | 4/1939 | Menachof | 40/125 |
| 2,186,913 | 1/1940 | Jonas | 40/23 |
| 3,310,025 | 3/1967 | Egner | 40/504 X |
| 3,457,664 | 9/1966 | Handley et al. | 40/145 |
| 3,468,047 | 6/1969 | Beatty | 40/10 |
| 3,478,452 | 11/1969 | Bitwell et al. | 273/32 H X |
| 3,599,981 | 8/1971 | Zausmer | 273/176 A |
| 4,086,715 | 5/1978 | Blonigen | 40/506 X |
| 4,247,994 | 2/1981 | Cullen | 273/32 R X |
| 4,843,525 | 6/1989 | Williams | 362/157 |
| 4,884,351 | 12/1989 | Abramson | 40/606 |
| 5,072,940 | 12/1991 | Bailey | 273/176 A |
| 5,114,149 | 5/1992 | Bailey | 273/176 A |
| 5,219,171 | 6/1993 | Kirby et al. | 273/32 |
| 5,230,297 | 7/1993 | Lakatos | 116/209 |
| 5,236,166 | 8/1993 | Darling | 248/519 |
| 5,356,134 | 10/1994 | DeMatteo | 273/32 |

FOREIGN PATENT DOCUMENTS 2202155 of 0000 United Kingdom .

*Primary Examiner*—George J. Marlo
*Attorney, Agent, or Firm*—Baker & Botts

[57] ABSTRACT

A distance indicator (10) is provided that comprises a housing (12). Distance indicator wheels (22), (24) and (26) are provided through openings (14), (16) and (18) of the housing and the information indicator (28) specifies the point from which the distance indicated by the distance indicator wheels (22), (24), (26) is measured. An information indicator (28) is provided through an opening (20) of the housing. The distance indicators are controlled using selectors (46), (48) and (50). The information indicator is controlled using a selector (44). The distance marker (10) enables the distance on a golf hole to be calculated by groundskeepers and to be reflected exactly for any placement of the tees on a pin on a given day.

4 Claims, 4 Drawing Sheets

GOLF DISTANCE MARKER

TECHNICAL FIELD OF THE INVENTION

This invention relates in general to the field of sporting equipment and distance markers and, more particularly, to an improved golf distance marker.

BACKGROUND OF THE INVENTION

Golf is the greatest game ever devised because it is the most difficult game ever devised. To successfully negotiate the treacherous lengths of a golf course, a player must accurately gauge distance and direction in order to successfully execute each required shot. The intended direction of a given shot is a fairly straightforward exercise and is dictated by the players' vision and the strategy of the moment. The distance of a shot, on the other hand, is quite another matter. As a multitude of hazards may befall the shot that travels short of or over its intended destination.

A variety of systems and methods have been used to inform golfers of their location on the course and the distance to a particular hazard or green on a golf course. Most of these systems share a common characteristic in that they are markers for fixed points on the golf course. A golfer then uses the fixed point to calculate the distance from his hall to the intended resting point of his shot or other points of interest such as the boundaries of hazards and the like. The time required to find such fixed markers, to measure the distance from the marker to a player's ball, and calculate the new distance has greatly contributed to the plague of slow play that has unfortunately infected the game of golf. This problem is especially prevalent for the tee boxes associated with each hole where one of the primary reasons for changing the location of the tee marker on the tee box is to prevent excessive wear and tear on any point of the tee box.

Accordingly, a need has arisen for a movable system and method of providing specific distance information readily visible from a distance to golfers that eliminates the time required for a golfer to calculate the distance of his shot relative to a fixed marker location facilitating proper club selection without having to calculate the distance on the tee box.

SUMMARY OF THE INVENTION

In accordance with the teachings of the present invention, a golf distance marker is provided that substantially eliminates or reduces disadvantages associated with prior systems and methods.

According to one embodiment of the present invention, a golf distance marker is provided that comprises a housing which comprises a plurality of openings. The housing contains three distance display wheels and one information display wheel. The distance display wheels may be set by a number of control dials. Similarly, the information display wheel comprises a plurality of messages which may be selected by manipulating a control dial coupled to the information display wheel.

According to another embodiment of the present invention, a tee marker sign includes a graphic display of the configuration of the hole associated with the sign. The sign includes distance displays for each of a plurality of tee boxes. In addition, the sign includes distance displays to particular points along the hole associated with each of the plurality of tee boxes.

BRIEF DESCRIPTION OF THE DRAWINGS

A more complete understanding of the present invention and the advantages thereof may be acquired by referring to the detailed description in conjunction with the accompanying drawings in which like reference numbers indicate like features and wherein.

DETAILED DESCRIPTION OF THE INVENTION

Figure 1:
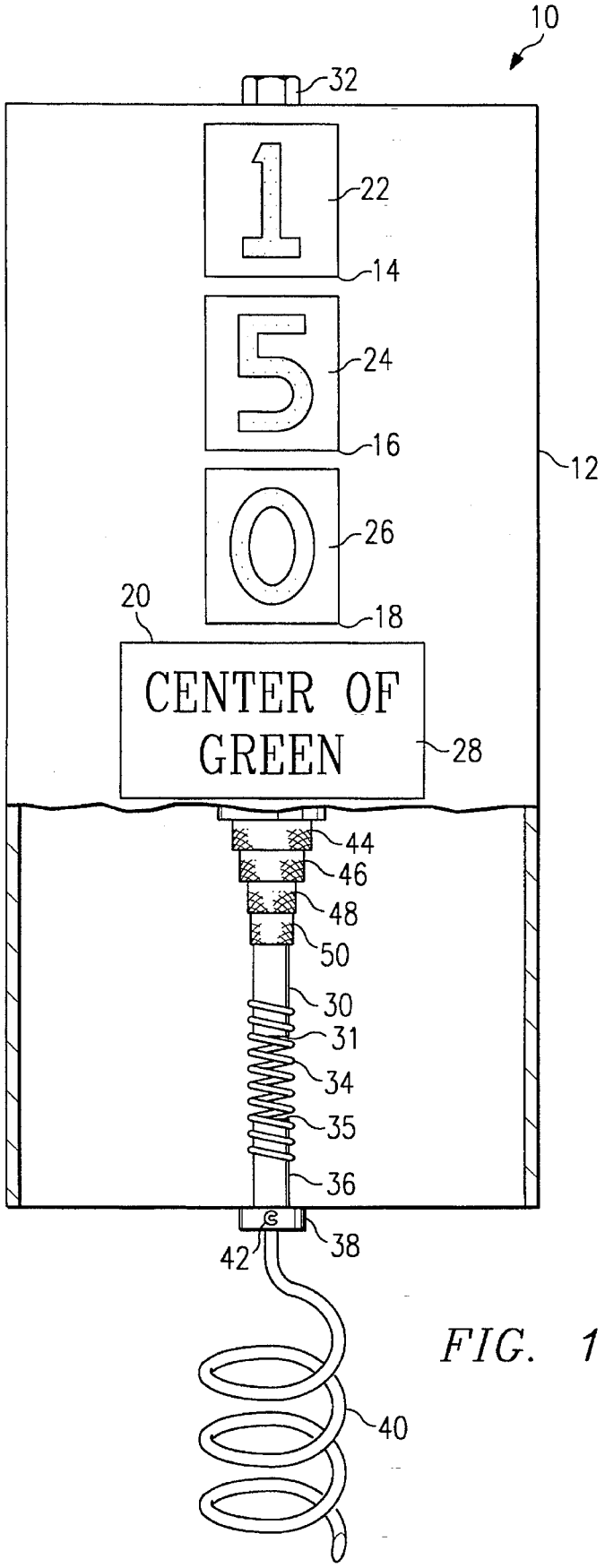
FIG. 1 is a partially cut-away drawing of a distance marker constructed according to the teachings of the present invention.

FIG. 1 illustrates a distance marker indicated generally at 10 constructed according to the teachings of the present invention. Distance marker 10 comprises a housing 12 which is constructed of a strong rigid material such as steel or rigid plastic. Housing 12 comprises openings 14, 16, 18 and 20. Through opening 14, one numeral of a distance wheel 22 is visible. Similarly, through opening 16, one numeral of a distance wheel 24 is visible. Similarly, through opening 18, one numeral of a distance wheel 26 is visible. According to one embodiment of the present invention, distance wheels 22, 24 and 26 are identical and each comprise ten faces, with each face containing a numeral or a blank space. With ten faces, the numerals 0 through 9 can all be displayed in each of the openings 14, 16 and 18. Distance wheel 22 may contain a blank face instead of the "0" face as it represents the hundredths place in a particular distance and will be blank for distances under 100 yards.

Through opening 20, a information wheel 28 is visible. Information wheel 28 may comprise, for example, five different faces which each display a different message. As shown in FIG. 1, one face of information wheel 28 might comprise the message "Center of Green". In operation, the distance marker 10 is set to the exact yardage to a particular location. The yardage is displayed through openings 14, 16 and 18, using distance wheels 22, 24, and 26. The information wheel 28 is then set to indicate the nature of the distance displayed. In the case of the message displayed in FIG. 1, the distance marker 10 would be placed at the tee box of a par-3 golf hole where the distance to the center of the green from the position of the distance marker 10 was 150 yards.

A portion of housing 12 has been cut away in the view illustrated in FIG. 1 to reveal a center shaft 30 that runs from the top of housing 12. Center shaft 30 is fixed to the top of housing 12 at nut 32 shown in FIG. 1.

Shaft 30 is connected to a spring 34. Spring 34 is extremely rigid but allows the housing 12 to withstand blows which may result from mowers striking the distance marker 10 inadvertently or from golfers who are displeased with the quality of their play striking the distance marker 10 advertently. The spring 34 is coupled to a lower shaft 36.

According to one aspect of the present invention, a lower surface 31 of upper shaft 30 is operable to abut an upper surface 35 of lower shaft 36 when a downward force is placed on spring 34. Suitable notches or grooves may be placed on surfaces 35 and 36 such that when they abut, shaft 30 and shaft 36 will rotate together. This action selectively fixes shafts 30 and 36 with respect to one another so that a winding or unwinding force is not placed on spring 34 when marker 10 is screwed into the ground or unscrewed out of the ground.

Lower shaft 36 is coupled to a lock ring 38. Lock ring 38 allows the upper portion of distance marker 10 to rotate with respect to a mounting screw 40 that is coupled to the lower portion of lock ring 38. Lock ring 38 includes a c-shaped aperture 42. Lock ring 38 comprises two concentric rings, an outer ring surrounding an inner ring. The outer ring is coupled to lower shaft 36 while the inner ring is coupled to mounting screw 40. C-shaped aperture 42 passes through both the inner and outer rings of lock ring 38. When a c-shaped key is placed in the apertures in both rings of lock 38, the rotation of the distance marker 10 will cause the simultaneous rotation of the mounting screw 40 and the distance marker 10 can either be driven into the ground or removed from the ground. If the locking ring 38 is not engaged with a c-shaped member through the aperture 42, the distance marker 10 cannot be removed from the ground. As such, lock ring 38 greatly deters theft or unauthorized placement of the distance marker 10. Aperture 42 is shaped in such a manner that a common object such as a golf tee or screwdriver cannot be used to lock the lock ring 38. For example, aperture 42 is shown to be c-shaped in FIG. 1, although other similar shapes would also suffice.

Distance wheel 22 is coupled to a selector dial 50 through a shaft that is not shown in FIG. 1. Similarly, distance wheel 24 is coupled to a selector dial 48. Distance wheel 26 is coupled to a selector dial 46 and information wheel 28 is coupled to a selector dial 44. Rotation of any of the selector dials 44, 46, 48 or 50 will cause the wheels 22, 24, 26 and 28, respectively, to rotate. As such, any distance and any message available may be displayed through openings 14, 16, 18 and 20 of housing 12.

Figure 2:
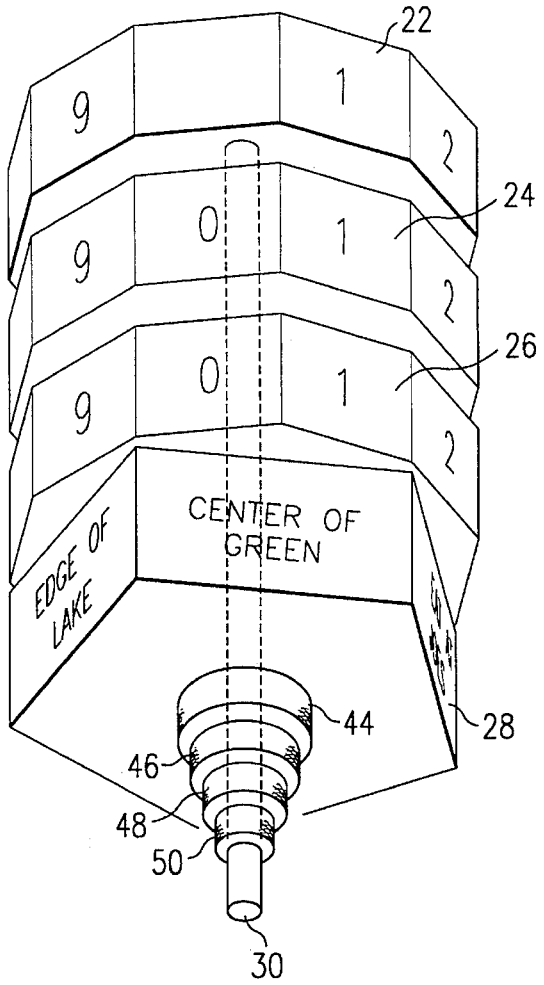
FIG. 2 is a drawing of the internal distance and information wheels used in one embodiment of the distance marker of the present invention.

FIG. 2 illustrates in greater detail the positioning of distance wheels 22, 24 and 26. FIG. 2 also illustrates the relative position of information wheel 28. As discussed previously, information wheel 28 is controlled by selector dial 44. Distance wheels 22, 24 and 26 are controlled by selector dials 50, 48 and 46, respectively. Selector dials 44, 46, 48 and 50 and wheels 22, 24, 26 and 28 rotate about central shaft 30.

Figure 3:
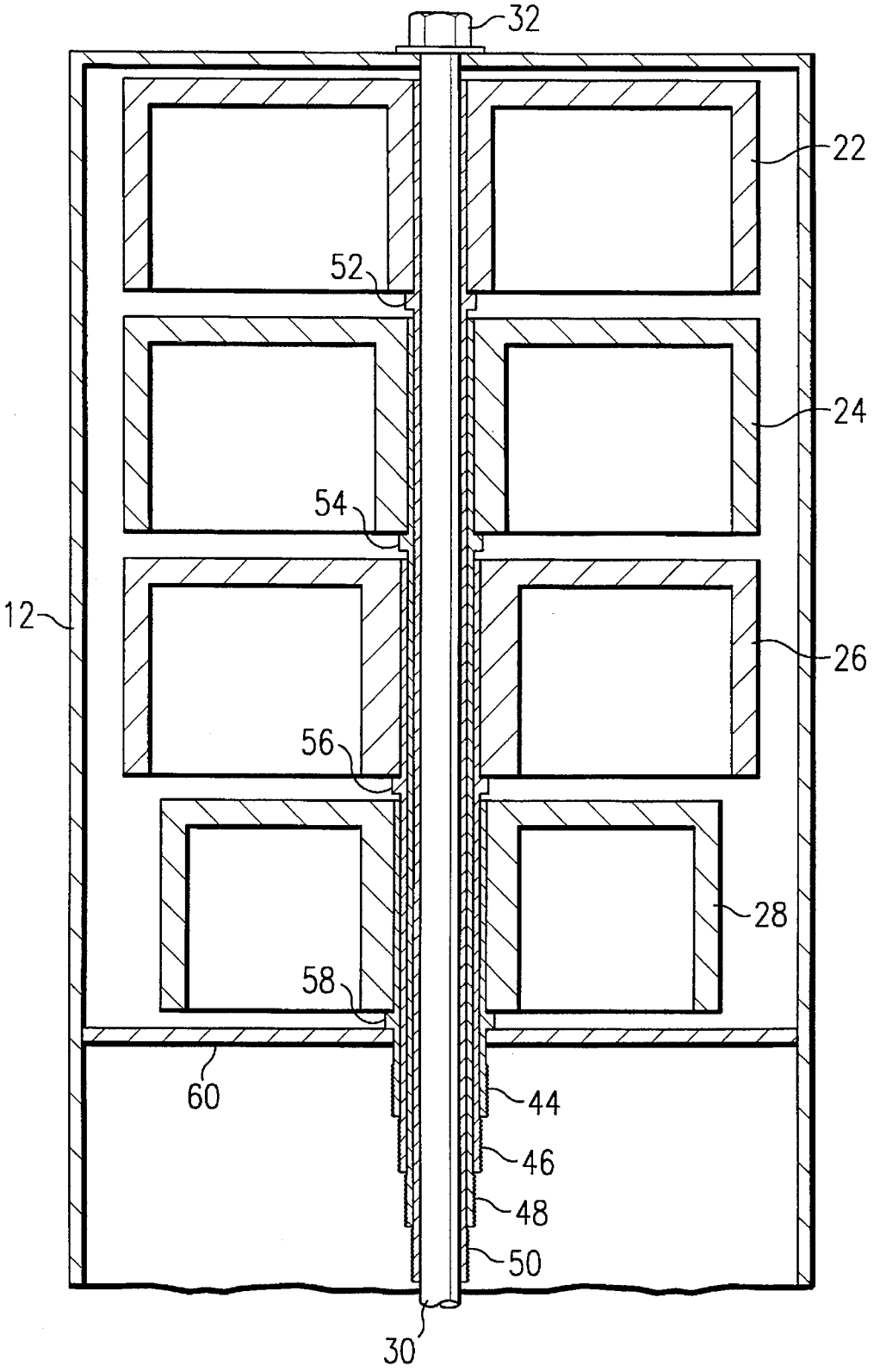
FIG. 3 is a cross-sectional diagram of a distance marker constructed according to the teachings of the present invention.

FIG. 3 shows the concentric construction of the distance wheels 22 through 28 and the selector dials 44 through 50. The distance wheels 22 through 28 are stacked, one on top of the other, with the distance wheel on top bearing against the upper surface of the distance wheel immediately beneath it. For example, distance wheel 22 includes spacer 52 which bears upon the top surface of distance wheel 24. Spacer 52 maintains the separation between distance wheels 22 and 24 and allows distance wheel 22 to freely rotate with respect to distance wheel 24 and shaft 30. Similarly, spacer 54 is disposed between distance wheel 24 and 26 and spacer 56 is disposed between distance wheel 26 and 28. A spacer 58 is connected to the base of information wheel 28 and spaces message wheel 28 from an internal support ring 60 which is fixed at its edges to the interior of housing 12.

According to an alternate embodiment of the present invention, distance wheels 22, 24 and 26 interact in the conventional method of a counter from the actuation of a single selector dial instead of three separate selector dials. According to this embodiment, when the unit's distance wheel 26 passes from 9 to 0, the upper surface of distance wheel 26 will engage a protrusion on the lower surface of distance wheel 24 to change distance wheel 24 to increment distance wheel 24. The same interaction occurs between distance wheel 24 and distance wheel 22. In this manner, a single selector dial may be used to set whatever distance is required. Although only a single dial would be required, more effort would be required to select a particular distance. For example, if the distance wheel needed to be changed from 0 to 500 yards, a great deal of turning of the single selector dial would be required. Further, the interaction of the distance wheels increases the complexity of the mechanism. As such, either system including a single selector dial or separate independent selector dials for the various distance wheels are equally viable solutions, depending upon the circumstance of the particular application.

The messages displayed on the information wheel 28 may comprise any number of messages relevant to the particular golf hole. For example, the messages may indicate that the distance displayed is at the center of the green, to a turning point on a dog leg hole, to a particular water hazard, or to a particular bunkers or trees that present themselves on the hole. Further, the messages displayed may wish the golf patrons a happy holiday or encourage the golf patrons to repair ball marks, to follow a particular pace of play, or provide advertising or sponsor of the hole. For example, a tee marker on the tenth hole might encourage the golfers that, if they are playing at an appropriate pace, they should reach the tenth hole two hours after they have started their round. In addition, the information indicator may indicate that the distance is not to the center of the green, but has been calculated to the pin, which would entail the groundskeeper to accurately reflect both the position of the tee markers and the pin placement for that day.

As discussed previously, housing 12 is cylindrical in shape. According to another aspect of the invention, other shapes with cylindrical openings in their base may be placed over the housing 12 to customize the distance markers for a particular season or golf community. These shapes may include suitable openings so that the distances and messages displayed through the openings in housing 12 can also be seen through openings within the shapes. These shapes may comprise, for example, seasonal shapes such as a heart for Valentine's Day, a pumpkin for Halloween, a watermelon or firecracker for Fourth of July, a football, baseball or soccer ball for various special events, a four-leaf clover, a turkey, a reindeer, a basketball, a pineapple, or any emblem associated with the golf course, such as palm trees or other emblems. The cylindrical shape of housing 12 and the easy access to the internal selector dials 44 through 50, allow for the use of external shapes fitted over housing 12.

Figure 4:
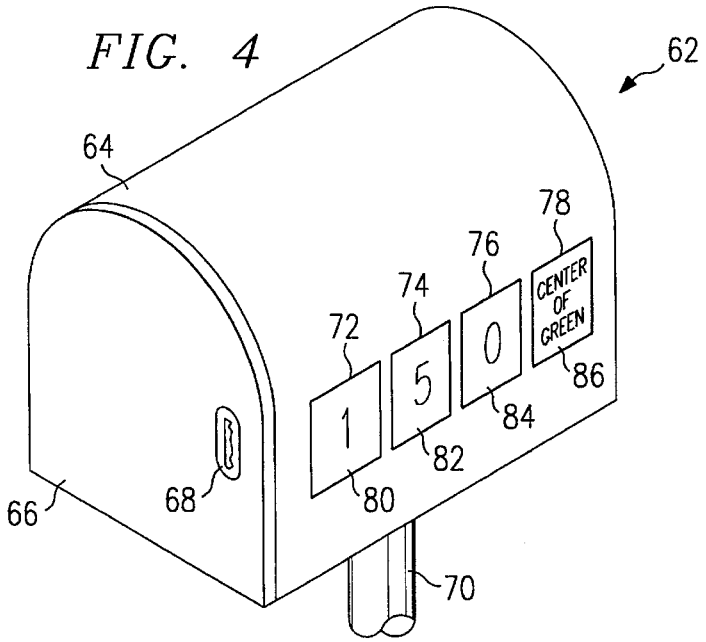
FIG. 4 is a drawing of an alternate embodiment of the distance marker of the present invention.

FIG. 4 illustrates an alternate embodiment of the present invention which comprises a distance marker 62. Distance marker 62 comprises a housing 64 with an access door 66, which is secured by a lock 68. Housing 62 rests on a shaft 70. Shaft 70 may also incorporate a spring such as spring 34 and a locking ring such as lock ring 38 described with reference to FIG. 1 previously. Housing 62 includes opening 72, 74, 76 and 78. Through opening 72 through 78, distance wheels 80, 82 and 84 and information wheel 86 are visible. The distance wheels 80 through 84 and the message wheel 86 are constructed identically to those described with reference to FIG. 1, except that they are placed horizontally within housing 62 as opposed to vertically as shown in FIG. 1.

The external shapes described with reference to housing 12 may also be used with distance marker 62 and housing 64. The external shapes used with marker 62 would have an aperture in their underside shaped to receive housing 64.

Figure 5:
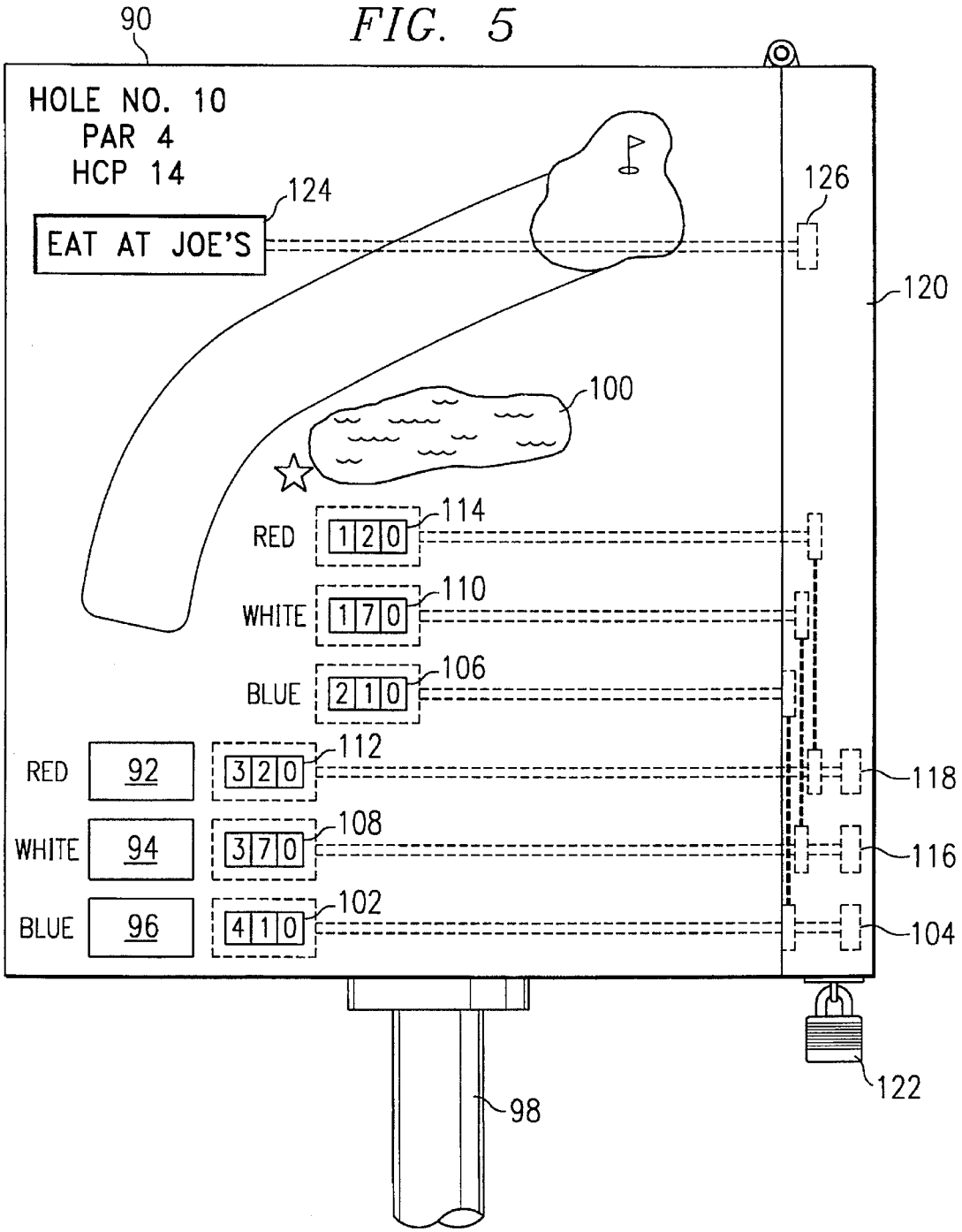
FIG. 5 is a drawing of an alternate embodiment of the distance marker of the present invention comprising a sign with distance displays incorporated in the sign.

FIG. 5 illustrates an alternate embodiment of the present invention which comprises a tee marker sign 90. Tee marker sign 90 includes a graphic representation of a golf hole. As shown in FIG. 5, the particular hole is the tenth hole, a par 4, which is the 14th handicap hole on the course. The hole is a dog leg right. The sign 90 illustrates, as is common in golf courses, that hole number 10 includes three separate tee boxes—a ladies' tee 92, a men's tee 94 and a championship tee 96. It should be understood that any number of tee boxes could be included without departing from the teachings of the present invention.

Sign 90 is supported permanently by a shaft 98. The tenth hole also includes a water hazard that is depicted on sign 90 at 100. A golfer teeing off on hole number 10 needs to know the distance to the pin from the tee box he is using. The golfer also needs to know the distance to the water hazard 100. As such, sign 90 includes settable distance indicators associated with each tee box and the distance from each tee box to the water hazard 100.

For example, the blue tee box includes distance indicator 102, that is set using selector dial 104. Manipulating selector dial 104 changes the value in distance indicator 102. Adjusting the selector dial 104 also changes the distance simultaneously in distance indicator 106. A distance indicator 108 and a distance indicator 110 are associated with the men's tees. A distance indicator 112 and a distance indicator 114 are associated with the ladies' tees. Distance indicators 108 and 110 are set using selector 116. Distance indicators 112 and 114 are set using selector dial 118.

Selector dials 104, 116 and 118 are covered by a lid 120 which is secure to the side of sign 90 by a lock 122 or other suitable security means. A groundskeeper or other authorized personnel sets the tee box for the day and measures the distance of the tee for that day from a particular known location such as a tree, fixed distance marker or other suitable indicia. The groundskeeper can then set the selector dials 104, 116 and 118 to reflect the appropriate distances for the tee box locations he has created for the day. As he sets each of the selector dials, the yardage indicators to the hazard 100 will simultaneously change to show the accurate distance to that hazard for that day.

Although sign 90 is shown with only two sets of distance indicators, one for the tee box and one for the hazard 100, it should be understood that many distance indicators could be included on a single sign. All of the distance indicators are simultaneously changed through a single selector dial to reflect the accurate distances for any tee box location. According to another aspect of the present invention, the indicators can be color coded. For example, championship tees are ordinarily colored blue. As such, the numerals within indicator 102 and 106 can be blue. In contrast, the numerals within indicator 108 and 110 can be white, and the numerals within indicators 112 and 114 can be red to reflect the tee boxes and to prevent confusion as to distances. Sign 90 can also include any number of information indicators, such as information wheels 28 and 86 described previously. These information wheels can be associated with any distance indicator or can be separate and independent with their own selector dials housed within lid 120.

For example, sign 90 may comprise an information window 124 controlled by a selector dial 126 and may display the same variety of information discussed previously.

Although the present invention has been described in detail, it should be understood that various changes, alterations, substitutions, and modifications may be made to the embodiments disclosed herein without departing from the spirit and scope of the present invention which is solely defined by the appended claims.

What is claimed is:

1. An adjustable distance marker for use on a golf course, comprising:

a housing including a plurality of indicator openings;

a plurality of numeric distance indicators, disposed adjacent to the openings in the housing such that distance information on the distance indicators can be viewed through the openings in the housing an information indicator disposed adjacent to one of the openings in the housing so that information on the information indicator may be viewed through one of the openings in the housing; the information specifying a point from which the distance indicated by the numeric distance indicator is measured;

a distance selector dial operable to change the distance information displayed by the distance indicators; and an information selector dial coupled to the information indicator and operable to change the information displayed by the information indicator.

2. The distance marker of claim 1 and further comprising a central shaft about which the distance indicators and information indicator rotate.

3. The distance marker of claim 2 and further comprising:

a spring coupled to the shaft;

a locking ring coupled to the spring; and a mounting screw coupled to the locking ring, the locking ring operable to selectively fix the mounting screw with respect to the spring.

4. The distance marker of claim 1 and further comprising a selector knob coupled to each digit of the distance indicators such that each digit of the distance indicator is separately selectable.

* * * * *